US006942308B2

(12) United States Patent
Molinet et al.

(10) Patent No.: US 6,942,308 B2
(45) Date of Patent: Sep. 13, 2005

(54) COMPENSATION OF LATERAL POSITION CHANGES IN PRINTING

(75) Inventors: Pep-Lluis Molinet, Barcelona (ES); Xavier Soler, Barcelona (ES); Manuel Lopez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 150 days.

(21) Appl. No.: 10/683,784

(22) Filed: Oct. 10, 2003

(65) Prior Publication Data

US 2005/0078133 A1 Apr. 14, 2005

(51) Int. Cl.[7] ..... B41J 3/00
(52) U.S. Cl. ..... 347/4; 347/15; 358/1.9
(58) Field of Search ..... 347/12, 15, 43, 347/42, 19, 4, 139; 399/116, 117, 159

(56) References Cited

U.S. PATENT DOCUMENTS 4,786,803 A 11/1988 Majette et al.
4,789,874 A 12/1988 Majette et al.
5,206,645 A 4/1993 Urich
5,300,961 A 4/1994 Corona et al.
5,411,340 A 5/1995 Elgee
5,587,771 A 12/1996 Mori et al.
6,089,693 A 7/2000 Drake et al.
6,155,669 A 12/2000 Donahue et al.
6,335,748 B1 1/2002 Furst
6,398,342 B1 * 6/2002 Neese et al. ..... 347/40
6,688,726 B2 * 2/2004 Bauer ..... 347/41

* cited by examiner

*Primary Examiner*—Lamson Nguyen

(57) ABSTRACT

A printing device has a plurality of print stations including dot-forming elements arranged to produce an image on a moving recording medium and provided in a redundant manner, thereby enabling dot-forming-element activity to be distributed between redundant dot-forming elements and errors of dot-forming elements to be compensated. A lateral-position detector arrangement or predictor is arranged to indicate the recording medium's lateral position relative to the print stations during a print process. A controller is arranged to use at least one print mask for each print station to distribute the dot-forming-element activity between the print stations and to compensate the errors of dot-forming elements. The printing device is arranged so that, in response to a detected or predicted change of the relative lateral position, at least one of the currently used print masks is replaced by another one relating to the changed relative lateral position.

47 Claims, 5 Drawing Sheets

Input image data
1st print station
Print mask of 1st print station
Area inked by 1st print station
Inked Area, arriving at 2nd print station
2nd print station
Print mask of 2nd print station
Area inked by 2nd print station
Printed image
20
5
21
22
22
5'
21'
22'
23 print process

COMPENSATION OF LATERAL POSITION CHANGES IN PRINTING

FIELD OF THE INVENTION

The present invention relates to compensation of lateral position changes in printing and, for example, to a method of compensating lateral position changes of a moving recording medium during a print process and to a printing device.

BACKGROUND OF THE INVENTION

Multicolor printers generate images which are composed of a plurality of different single-color images. The quality of the final multicolor image depends on the accuracy of the alignment of the individual images (also called "registration accuracy"). With the increasing resolution of modern printers the registration accuracy has become an issue of interest.

Different printing techniques are known. For example, in ink-jet printing droplets of liquid ink are directed from print heads towards a recording medium. Each print head has a plurality of ink channels. Pulses cause droplets of ink to be expelled as required from dot-forming elements in the form of orifices or nozzles at the end of the channels. These pulses are generated e.g. by thermal components in thermal ink-jet print heads or by piezo-electric elements in drop-on-demand print heads. Page-wide array ink-jet printers have an array of nozzles extending across the full width of the recording medium. The recording medium may be paper or any other suitable substrate to which the ink adheres, and is moved past the print heads by a conveyor formed, for example, by a belt or a drum.

The print heads are arranged in print stations which are typically transversely oriented to the conveyors advance direction and are spaced apart from each other in the advance direction. Due to the spaced arrangement of the print stations, the individual images are subsequently printed. If the distance between the print stations is smaller than the image length the individual images are printed in a staggered manner. Accordingly, the multicolor image to be printed is virtually separated into individual images to be printed by the respective print stations. In order to achieve registration of the images with respect to the advance direction (or longitudinal direction), the printing activity of the individual print stations is delayed until the image printed by the first print station arrives at the respective subsequent print station.

Assuming that the conveyor only moves the recording medium in the longitudinal direction, registration can be achieved by choosing the correct delays. However, small movements in a direction perpendicular to that may cause a lateral displacement of the recording medium from one print station to the other and, accordingly, a lateral misalignment of the individual images. Such lateral displacements may, for example, occur when the conveyor belt runs askew or performs oscillatory lateral movements.

In order to also achieve registration with respect to such lateral displacements, it is known to shift the image data to be printed by the individual print stations to compensate for this lateral displacement (see, for example, U.S. Pat. Nos. 5,587,771 and 6,335,748).

A printing device with a conveyor in the form of a rotating drum is known from U.S. Pat. No. 6,089,693. The printing device has a single print station. Due to large numbers of dot-forming elements (nozzles) in the print station, generally one or more of the nozzles will be defective. During a first pass (i.e. a first revolution of the drum), the print station prints the complete image, except for one or more columns corresponding to the defective nozzle or nozzles. Then the print station is laterally shifted, so that an operative nozzle is aligned to the original position of the defective nozzle. During a second pass (i.e. a second revolution of the drum) the missing column(s) is (are) printed.

SUMMARY OF THE INVENTION

A first aspect of the invention is directed to a printing device. According to the first aspect, the printing device comprises: a plurality of print stations including dot-forming elements arranged to produce an image on a moving recording medium and provided in a redundant manner, thereby enabling dot-forming-element activity to be distributed between redundant dot-forming elements and errors of dot-forming elements to be compensated; a lateral-position detector arrangement or predictor arranged to indicate the recording medium's lateral position relative to the print stations during a print process; and a controller arranged to use at least one print mask for each print station arranged to distribute the dot-forming-element activity and to compensate the errors of dot-forming elements. The printing device is arranged so that, in response to a detected or predicted change of the relative lateral position, at least one of the currently used print masks is replaced by another one relating to the changed relative lateral position.

According to another aspect a printing device is provided, comprising: a plurality of print stations including dot-forming elements arranged to produce an image on a moving recording medium and provided in a redundant manner, thereby enabling dot-forming-element activity to be distributed between redundant dot-forming elements and errors of dot-forming elements to be compensated; a lateral-position detector arrangement or predictor arranged to indicate the recording medium's lateral position relative to the print stations during a print process; a controller arranged to use at least one print mask for each print station arranged to distribute the dot-forming-element activity and to compensate the errors of dot-forming elements; and a print-mask memory arranged to store print masks for different lateral recording medium's positions. The controller is arranged, in response to a detected or predicted change of the lateral position, to use at least one other print mask from the stored print masks than the currently used one, this at least one other print mask relating to the changed lateral position.

According to another aspect a printing device is provided, comprising: at least one print station including dot-forming elements arranged to produce an image on a moving recording medium; a drum arranged to convey the recording medium past the at least one print station, wherein, by performing more than one turn, the drum is enabled to convey the recording medium more than once past the at least one print station, thereby creating an effective dot-forming-element redundancy; a lateral-shift mechanism arranged to perform a relative lateral shift between the print station and the recording medium from one drum turn to another drum turn, thereby enabling dot-forming-element activity to be distributed between drum turns and errors of dot-forming elements to be compensated; a lateral-position detector arrangement or predictor arranged to indicate the relative lateral shift between the recording medium and the print station; and a controller arranged to use at least one print mask for the at least one print station for each drum turn and each detected or predicted relative lateral position between the print station and the recording medium. The print masks are arranged to distribute the dot-forming-element activity between the drum turns and, in addition, to compensate the errors of dot-forming elements.

According to another aspect a printing device is provided, comprising: at least one print station including dot-forming elements arranged to produce an image on a moving recording medium; a drum arranged to convey the recording medium past the at least one print station, wherein, by performing more than one turn, the drum is enabled to convey the recording medium more than once past the at least one print station, thereby creating an effective dot-forming-element redundancy; a lateral-shift mechanism arranged to perform a relative lateral shift between the print station and the recording medium from one drum turn to another drum turn, thereby enabling dot-forming-element activity to be distributed between drum turns and errors of dot-forming elements to be compensated; a lateral-position detector arrangement or predictor arranged to indicate the recording medium's lateral position relative to the print station; a print-mask memory arranged to store print masks for each drum turn and each detected or predicted relative lateral position between the print station and the recording medium, wherein the print masks are arranged to distribute the dot-forming-element activity between the drum turns and in addition to compensate the errors of dot-forming elements; and a controller arranged to use at least one print mask from the stored print masks for the at least one print station during the printing operation.

According to another aspect a method is provided of compensating lateral position changes of a moving recording medium during a print process, in which at least one image is printed by a plurality of print stations including dot-forming elements, based on image data. Redundant dot-forming elements are provided, thereby enabling dot-forming-element activity to be distributed between redundant dot-forming elements, and errors of dot-forming elements to be compensated, by using print masks. The method comprises: detecting or predicting the lateral position of the recording medium relative to the print stations during a print process; using the image data and at least one print mask for each print station to distribute the dot-forming-element activity between the print stations and to compensate the errors of dot-forming elements; and replacing, in response to a detected or predicted change of the lateral position, at least one of the currently used print masks by another one relating to the changed relative lateral position.

According to another aspect a method is provided of compensating lateral position changes of a moving recording medium during a print process, in which at least one image is printed by a plurality of print stations including dot-forming elements, based on image data. Redundant dot-forming elements are provided, thereby enabling dot-forming-element activity to be distributed between redundant dot-forming elements, and errors of dot-forming elements to be compensated, by using print masks, wherein a set of such print masks for different relative lateral positions of the recording medium is pre-calculated and stored. The method comprises: detecting or predicting the lateral position of the recording medium relative to the print stations during a print process; using the image data and at least one print mask for each print station to distribute the dot-forming-element activity between the print stations and to compensate the errors of dot-forming elements; and using, in response to a detected or predicted change of the relative lateral position, at least one other print mask from the stored print masks than the currently used one, this at least one other print mask relating to the changed relative lateral position.

According to another aspect a method is provided of compensating lateral relative position changes of a moving recording medium during a print process, in which at least one image is printed, based on image data, by at least one print station of a drum system during more than one drum turn. Effective dot-forming-element redundancy is created by executing additional drum turns and laterally shifting the print station between drum turns, thereby enabling dot-forming-element activity to be distributed between the drum turns and errors of dot-forming elements to be compensated, by using print masks. The method comprises: detecting or predicting the lateral position of the recording medium relative to the at least one print station during a print process; using the image data and at least one print mask for each print station for each drum turn and detected or predicted relative lateral position between the print station and the recording medium, wherein the print masks distribute dot-forming-element activity between the drum turns and, in addition, compensate the errors of dot-forming elements.

According to another aspect a method is provided of compensating lateral relative position changes of a moving recording medium during a print process, in which at least one image is printed, based on image data, by at least one print station of a drum system during more than one drum turn. Effective dot-forming-element redundancy is created by executing additional drum turns and laterally shifting the print station between drum turns, thereby enabling dot-forming-element activity to be distributed between the drum turns and errors of dot-forming elements to be compensated, by using print masks. A set of such print masks for different relative lateral positions of the recording medium is pre-calculated and stored. The method comprises: detecting or predicting the lateral position of the recording medium relative to the at least one print station during a print process; and using the image data and at least one print mask from the stored print masks for each print station for each drum turn and detected or predicted relative lateral position between the print station and the recording medium, wherein the print masks distribute dot-forming-element activity between the drum turns and, in addition, compensate the errors of dot-forming elements.

Other features are inherent in the methods and products disclosed or will become apparent to those skilled in the art from the following detailed description of embodiments and its accompanying drawings.

DESCRIPTION OF THE DRAWINGS

Embodiments of the invention will now be described, by way of example, and with reference to the accompanying drawings, in which.

DESCRIPTION OF THE PREFERRED EMBODIMENTS

Figure 1:
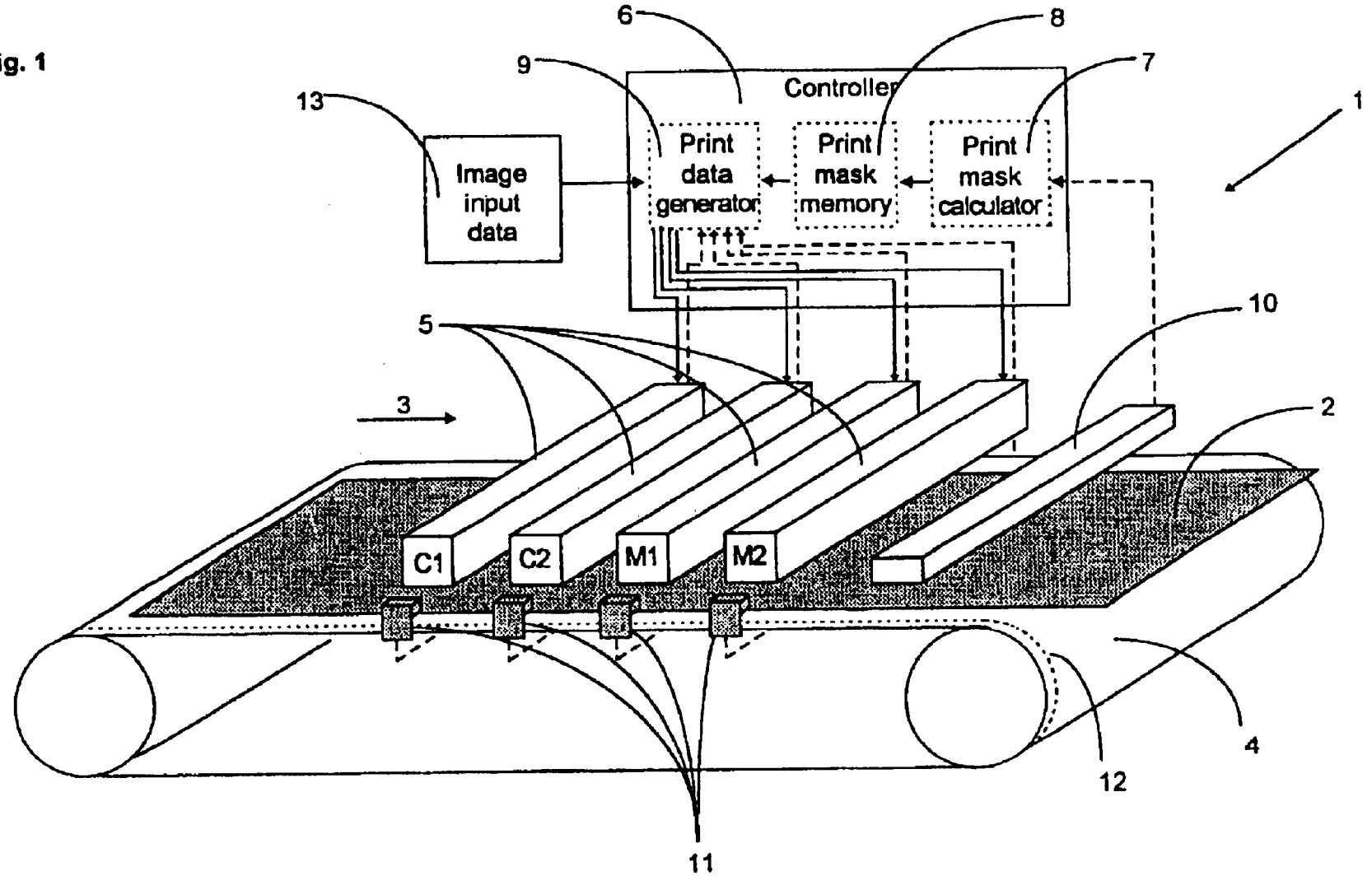
FIG. 1 illustrates an embodiment of a printing device having a belt conveyor.

FIG. 1 illustrates an embodiment of a printing device. Before proceeding further with the detailed description of FIG. 1, however, a few items of the embodiments will be discussed.

In some of the embodiments, the printing device is equipped with a plurality of print stations which are successively passed by the recording medium conveyed by a conveyor (e.g., a belt) during a print process. The print stations are arranged to print single-color images. In embodiments enabling multi-color images to be printed, each print station prints a part of the entire multi-color image. The printing is based on input image data virtually separated into data representing the individual image parts printed by the respective print stations. A multicolor image is typically separated into four single-color images (the separation is, for example, based on the basic colors cyan, magenta, yellow and black). As will be explained below, the print stations have dot-forming elements (e.g. nozzles) which, in some of the embodiments, are arranged in a redundant manner for each individual color. In some of these embodiments, the redundancy is achieved by doubling the print stations for each color; i.e. these embodiments have two cyan, magenta, yellow and black print stations. In other embodiments, each single-color print station has a redundant arrangement of dot-forming elements, e.g. four print stations with two page-wide arrays of dot-forming elements. Redundant print stations (or redundant arrangements of dot-forming elements) form what is called a "redundancy group"; for example, two redundant print stations of the same color form a redundancy group.

In other embodiments, redundancy is not achieved by doubling (or multiplying) the number of print stations of the different colors, but rather by doubling (or multiplying) the number of times the recording medium is moved past a print station (i.e. the number of passes), and by laterally shifting the print station relative to the recording medium between two subsequent passes. In some of these other embodiments, the conveyor is in the form of a rotating drum facing a print station (or several print stations for different colors). The recording medium is attached to the surface of the drum, and the several passes of the recording medium are performed by repeated revolutions of the drum.

The redundancy (either achieved by multiplying the number of print stations or the number of passes) enabling the dot-forming-element activity to be distributed between the redundant dot-forming elements or the different passes. For example, the first print head of two redundant print heads prints about one half of the dots or of the picture elements (analogously, during a first pass the first half may be printed, and during a second pass the second half), and the second print head prints the other half. Generally, the print activity may be distributed such that blocks of contiguous dots or picture elements printed by one print station or in one pass are minimized or, at least, reduced, which improves image quality. For example, in the case of a distribution between two print stations or passes, the print activity may be distributed according to a checkerboard-like pattern. Furthermore, the redundancy enables an "error hiding", i.e. defective (or faulty) dot-forming elements to be compensated by operative dot-forming elements, as will be explained in more detail below. In embodiments in which redundancy is achieved by several passes, the print station and the recording medium are laterally shifted relative to each other between passes, in order to enable an operational dot-forming element to take over the function of a faulty one, in the second pass.

Distributing the print activity means, herein, distributing it to a greater extent than would be required to obtain only error hiding. In other words, it means that the print activity is distributed between different print stations or passes, even in the case in which all dot-forming elements are operational (i.e. in the case in which no errors are hidden). In contrast, in the U.S. Pat. No. 6,089,693 mentioned at the outset, not distributed printing is performed since everything is printed during the first pass, but only the task of the defective nozzles is performed by shifted operational nozzles during the second pass (i.e. nothing is printed in the second pass if all nozzles are operational).

In the embodiments, the recording medium is paper or any other suitable substrate. It may be subdivided in sheets (e.g. paper sheets). A print process may extend over one sheet or several sheets.

In some of the embodiments, the recording medium is advanced by a belt conveyor in the longitudinal direction. While conveyed past the print stations, the recording medium may change its lateral position. The recording medium's displacement in the lateral direction may, for example, be due to a corresponding lateral belt displacement occurring during the mainly longitudinal belt movement. In embodiments having a drum conveyor, the recording medium may also move laterally relative to the drum during the drum revolutions. Furthermore, shifting the print station between two drum revolutions also represents a relative lateral shift between the recording medium and the print station. When the mechanism causing the lateral shift of the print station is not controlled to a precision corresponding to the print resolution, an uncontrolled relative lateral movement between print station and recording medium will appear from one drum revolution to the other. In principle, a lateral displacement of the drum might also occur.

A lateral displacement between the different print stations, or the different revolutions, would, in principle, result in a "misregistration" of the individual images printed. In order to enable such a lateral displacement to be compensated, the recording medium's relative lateral position is either detected or predicted for each print station. In some of the embodiments, the detection or prediction is indirect, in the sense that the belt's or drum's lateral position is detected or predicted for each print station, and it is assumed that a detected or predicted lateral position change of the belt or drum causes a corresponding lateral position change of the recording medium. In belt-conveyor embodiments with lateral position detection, a lateral-position detector arrangement is provided at each print station. For example, in one embodiment, the conveyor belt is equipped with encoding marks indicative of the belt's lateral position (e.g. encoding marks with two angled positions), and the sensor arrangement has sensors responsive to the encoding marks and arranged to determine the belt's lateral position from the detected encoding marks.

In other embodiments (belt or drum embodiments) the encoding marks may be applied to (e.g. printed on) the recording medium itself, in order to directly detect the recording medium's relative lateral position.

In still other embodiments, in which a recording medium with an irregular surface structure (such as a paper-fiber structure) is used, the detector arrangement is arranged to directly detect the recording medium's lateral position without such pre-applied marking on the recording medium. Images of the surface structure are taken with the detector arrangement at the first print station, or during the first drum revolution, as the recording medium advances, and are stored in a memory. At the second (or subsequent) print station, or drum revolution, images of the surface structure are taken with the detector arrangement and compared with the corresponding stored surface images taken at the first print station, or drum revolution. A lateral shift of the second images shifted with respect to the stored first ones can be detected and used as an indication of a corresponding lateral shift of the recording medium. However, basing the lateral-shift detection on a comparison of different surface images implies that a lateral shift can only be detected when the shifted recording medium reaches the second detector, or when the second revolution is performed. A suitable surface image recording device is described in U.S. Pat. No. 6,118,132.

In still other drum embodiments the lateral-position detector arrangement detects the actual lateral position of the laterally movable print station(s).

In some embodiments, the lateral conveyor or recording medium position depends, in a reproducible manner, on a known parameter of the conveyor (which is, for example in a belt embodiment, the case if the belt produces a reproducible lateral oscillation depending on the longitudinal belt position). This enables the lateral conveyor or recording medium position to be predicted for each print station or drum revolution by a model calculation, the input parameter of which is, for example in belt embodiments, the current longitudinal belt position.

Some embodiments use a combination of detection and prediction. For example, in a belt embodiment, the belt's lateral position is measured at one or two points along the belt (e.g. before the first and after the last print station), and its lateral positions at each print station are then predicted by extrapolation or interpolation, based on this measurement. The either detected or predicted lateral positions are then input into a controller to compensate for lateral shifts, as will be explained below.

Each print station includes at least one page-wide array of dot-forming elements. A print station may be subdivided, along the width of the print station, in several independent sub-arrays of dot-forming elements, called "print heads". The print heads can be exchanged independently from one another, which obviates a need to replace a complete print station in the event of a fault which affects only a part of the print station. In ink-jet printer embodiments, the dot-forming elements are orifices or nozzles, through which droplets of liquid ink are ejected towards the recording medium. Embodiments using other printing techniques have analogous dot-forming elements, for example, in laser printers the dot-forming elements may be laser diodes directed to a recording medium in the form of a charged photosensitive print roller arranged to become discharged in illuminated areas. A charged toner is then only taken up by the discharged areas and transferred to an output paper sheet. To render the following description more illustrative, the specific term "nozzles" is used hereinafter; it also stands for other dot-forming elements, such as light-emitting diodes.

In high-resolution printers, each print head has a very large number of nozzles (typically in the order of $10^3$–$10^5$). Some of a print head's nozzles will inevitably become faulty in time. For example, in the case of ink jet printers, faulty nozzles may be nozzles emitting in a false direction, or emitting no ink, insufficient ink or abundant ink. Owing to the large number of nozzles in a print head, typically some of them will be faulty, even if the error frequency referring to an individual nozzle is small. It is economically not feasible to replace a print head, if only a few nozzles are faulty. However, in order to maintain good image quality the function of faulty nozzles is taken over by operative nozzles. Accordingly, an approach called "error hiding" has been adopted in the embodiments. It enables nozzle errors to be compensated without physically replacing any parts of the printing device. In order to achieve this, in some of the embodiments the nozzles are arranged in a redundant manner. For example, two identical print stations may be provided for each color. If a nozzle becomes faulty in one of the two print stations, its function can be taken over by one or more corresponding replacement nozzles of the other one of the two print stations, thereby hiding (i.e. effectively eliminating) the error. Shifting the task of a faulty nozzle to a corresponding (originally redundant) one is performed by using print masks, as will be explained below. In the following example, for sake of simplicity, it will be considered the case in which each nozzle can be replaced just by one corresponding redundant nozzle, which is the normal case when, for instance, the printer is printing at a printing resolution corresponding to the nozzle resolution. Clearly, when the printing resolution is lower that the nozzle resolution, more nozzles can print the same information and then more nozzles can be used for replacing the error nozzle. The same mechanisms and methods described in the following can still be applied to printer printing at resolutions allowing one nozzle to be replaced by a corresponding nozzle chosen out of a plurality of nozzles.

In the embodiments, the printing device is equipped with a nozzle-error detector, for example, in the form of a page-wide optical sensor array. In some embodiments, test print-outs are produced from time to time and viewed by the sensor array. The images printed as test print-outs are chosen such that they enable a missing or otherwise abnormal ink dot to be assigned to a certain nozzle in a certain print head, thereby enabling faulty nozzles to be identified. For example, dots from different print heads or rows of nozzles are not printed in an overlaid manner, but individually in the test print-out to enable the assignment mentioned above. In other embodiments, the information obtained by the optical sensor array by viewing images printed by the ensemble of print heads during the printers normal operation is used to identify faulty nozzles. Owing to the fact that, typically, at least in some regions of the printed multicolor images only a single-color inking is required, comparing the actually printed images in such regions with the desired printed images also enables missing or otherwise abnormal ink dots to be detected and assigned to certain nozzles in certain print heads. Accordingly, in the latter embodiment faulty nozzles can be identified without test print-outs.

In still further embodiments, each print station is equipped with an individual nozzle-error detector which is arranged to directly detect faulty nozzles, e.g. by monitoring ink drop generation, but without "looking" at the print result on the paper. For example, in some embodiments, the nozzle-error detector is made up of a plurality of light barriers crossed by the ink drops expelled by the nozzles. A fault of a nozzle is indicated if the light barrier associated with a certain nozzle is not interrupted when the nozzle is fired. In other embodiments, a nozzle-error detector is provided which analyzes the noise produced by the nozzles upon operation; faulty nozzles are identified by missing or abnormal noise production. In still further embodiments, a capacitive nozzle-error detector is used which measure capacitive changes when a nozzle is fired, and detects faulty nozzles by missing or abnormal capacitive changes. Data representing information about faulty nozzles is stored and used to produce error-hiding print masks.

Print masks are (preferably two-dimensional, but can also have three or more dimensions) control tables (or patterns) for controlling the activity of the individual nozzles for the individual rows of the image to be printed. The print masks control the distribution of print activity between redundant nozzles or drum turns, and also control the error hiding. The print masks are independent of a particular image to be printed, i.e. the particular image information is carried by the input image data (but they may depend on the image type). Each print station has its individual print mask or masks. In practice, when a print stations segmented into print heads, the print mask of a print station may be correspondingly segmented, so that each print head may have its own print mask. However, the terminology used herein refers to a "print mask" as the print mask of an entire print station (which may actually be an assembly of smaller print masks, each associated with a print head). For example, the print mask of a certain print station defines each nozzle of this print station to be "enabled" or "disabled", which means that the respective nozzle is enabled to print or remains inactive. As a simple example, a logical AND is formed between the input image and the print mask for each image dot; if, for a certain image in a certain line, the input image requires ink to be applied to the dot (logical "1") and the print mask enables the corresponding nozzle (logical "1") in this line, the nozzle is activated (i.e. it applies ink). However, if the input image defines that no ink is to be applied (logical "0"), and/or the print mask disables the nozzle (logical "0"), the nozzle is not activated (i.e. no ink is applied to this dot). In some of the embodiments, more complicated print masks are used, for example, to achieve half-toning besides print-activity distribution and error hiding. In these embodiments, more than one nozzle is provided for each picture element (pixel) of the input image; for example, four nozzles are provided for each pixel. By activating one, two, three or four of a pixel's nozzles, four different color densities can be printed (this technique is also called "dithering"). The print mask for each pixel may be a threshold matrix which defines that the respective nozzle is only enabled if the input image's color density for this pixel is above the respective threshold. Accordingly, in the embodiments using half-toning, the logical-AND procedure described above may be replaced by a thresholding procedure. In some embodiments, separate print masks for print-activity distribution with error hiding and half-toning are used for every print station. The nozzle activity of a print station may then be controlled by a logical combination of the separate print masks.

As already mentioned above, in the embodiments, the nozzles are provided in a redundant manner, or redundancy is achieved by multiple drum turns to enable the print activity to be distributed and nozzle errors to be hidden. For example, in some embodiments, the redundancy is achieved by doubling the number of single-color print stations, e.g. by providing two cyan, magenta, yellow and black print stations, which are eight print stations in total. In the embodiments, the print masks define how a printing task is distributed between the redundant nozzles, i.e. which one of two redundant nozzles is activated to apply ink to a particular dot, and which one is not activated. For example, in the ideal case of print stations without any nozzle errors, the print masks of two redundant print stations of one color which form a redundancy group (which may also be represented by one and the same print station in two different drum turns) may be arranged like complementary checkerboard patterns. Such complementary checkerboard patterns equally distribute the print task to the two print stations of a redundancy group and add up to a complete coverage. More generally, the print masks of redundant print stations associated with each may be complementary patterns minimizing or reducing blocks of contiguous dots or picture elements printed by each print station, or during each drum turn. Distributing the print activity typically improves the image quality achieved since, for example in ink jet printing, it enables the ink applied by the first print station, or during the first drum turn, to dry until the print process is continued, thereby enabling more ink to be applied, which may improve the color intensity. Furthermore, combining error hiding with distributed printing provides better quality than printing only missing columns of defective nozzles in a second pass, since such columns may be visible in the final printed image. Although a symmetric distribution (50%:50% between two redundant print stations) is advantageous, in some embodiments an asymmetric distribution of the print activity is chosen, for example 70% of the print activity by the first print station, or in the first drum turn, and only 30% by the second print station, or in the second turn, in particular in embodiments in which not all faulty nozzles of the second print station, or the second turn, are hidden by the print activity of the first print station, or in the first turn, as will be explained below.

If faulty nozzles are present, the print masks which distribute the print activity between the nozzles of a redundancy group, or between drum turns, in a normally regular manner, are modified so as to hide the nozzle errors. For example, assuming that one nozzle in one of the print stations of a redundancy group has become faulty. Then, in the print mask associated with this print station, all fields in the print-mask row corresponding to the position of the faulty nozzle are set to "0". Thereby, for example, the regular checkerboard pattern mentioned above is disturbed. In the print mask of the other print station of the redundancy group, all fields of the corresponding print-mask row are set to "1", so that the two masks are complementary. Accordingly, the faulty nozzle is disabled, and its print task is taken over by the corresponding other nozzle of the redundancy group. The nozzle error will not appear in the print-out. In the embodiments, the printing device is arranged, upon identification of new nozzle errors, to calculate new print masks taking into account such newly discovered nozzle errors and to replace the currently used print masks by these updated ones.

As explained above, in the embodiments, lateral shifts of the recording medium detected at a certain print station are compensated by data shift operations, so as to maintain the registration of the individual images printed onto each other. However, as can be seen from the example above, the printing activity of the print stations belonging to a redundancy group, or during different passes, are correlated; accordingly, if one requires the print masks associated with redundant print stations to be complementary and provide full coverage, when combined, at least the print masks of the print stations forming a redundancy group are correlated. Due to the print masks' correlation, it is generally not sufficient only to shift the input image in order to compensate for a lateral recording medium displacement at a particular print station. This is because shifting only the image data without shifting the print mask of the respective print station would result in an image in which some dots are erroneously left blank, and on other dots ink would be applied twice. On the other hand, if the print mask associated with the respective print station were shifted together with the image, it would no longer be complementary to the print mask of the other print station of the redundancy group. This, in turn, would cause some dots to be left blank or inked twice. Therefore, if a lateral displacement is detected at a certain print station, the current print mask associated with this print station is replaced by another print mask relating to the changed lateral position. This new print mask, in principle, is a shifted print mask, in which the amount of shift corresponds to the detected lateral shift of the recording medium. However, those parts of the print mask which correspond to faulty nozzles of the respective print station are not shifted together with the whole print mask. Rather, in the new print mask these parts are located at a different position within the mask, so as to take into account that, although the mask has been shifted, that the faulty nozzles have not been shifted. Owing to the correlation of the print masks of the print stations of a redundancy group, the print mask of the other print stations of the redundancy group are also replaced by new complementary print masks, i.e. print masks which take into account that the position of the faulty nozzles have effectively been changed in the print mask of the print station at which the lateral shift has been detected. In other words, the print masks of all print stations of a redundancy group, between which a relative lateral shift of the recording medium has been detected are replaced by new print masks taking into account this lateral shift.

With regard to error hiding, the correlation between two print stations forming a redundancy group requires the first print station (or the print station during the first pass) to take over the printing activity of the second print station (or the laterally shifted position of the print station during the second pass) for those columns in which a second print station (or the print station at the laterally shifted position) has faulty nozzles. Vice versa, the second print station (or the print station during the second pass) has to take over the print activity of the first print station (or the print station during the first pass) for those columns in which the first print station has faulty nozzles. In principle, this requires not only the print mask of the second print station of a redundancy group (or the second pass), but also the print mask of the first print station (or the first pass) to be replaced by print masks relating to the new relative lateral position, in order to make the two print masks fully complementary and achieve complete error hiding. However, there are a couple of cases in which the first print station has already printed its partial image, or a part of it. What has already been printed, cannot be changed any more. In particular, for that part which the first print station already printed, it will not be able to take over the printing activity of the second print station's faulty nozzles, since these nozzles will now, after the occurrence of the relative lateral shift, be effectively positioned at different lateral positions from the ones assumed by the first print station before the lateral shift occurred. Only the second print station is able to still take into account the relative lateral shift and take over the print task of the first print station's faulty nozzles. Therefore, using a new print mask relating to the new relative lateral position at the second print station (or the second pass) enables a partial error hiding, but a perfect error hiding will generally not be achievable in such cases of a "delayed" detection of a relative lateral replacement. For example, when a belt of a belt conveyor changes its skew angle resulting in a relative lateral displacement at the second print station, that part of the image which has already been printed by the first print station, but has not yet been printed by the second print station, will not be affected any more by the new print mask for the first print station relating the new relative lateral position, but will only be affected by the new print mask for the second print station. Therefore, for a "transitional phase" (which lasts until the print-out of first print station printed with the new print mask reaches the second print station), no complete error hiding will be achieved. Complete error hiding will be achieved for that part of the image printed by the first print station after the first print station's print mask has been replaced by another print mask relating to the changed relative lateral position.

In printing devices in which redundancy is achieved by multiplying the number of print stations, the length of this transitional region corresponds to the distance between the first and last print station of a redundancy group, and may thus be minimized by arranging the print stations belonging to a redundancy group as close as possible in the advance direction.

In embodiments in which the redundancy is achieved by multiplying the number of passes, the transitional region tends to be longer. For example, if the paper on the drum of a drum conveyor is laterally displaced in the middle of the first drum revolution, the already printed first half of the image printed during the first revolution is a "transitional region". In the case in which the relative lateral displacement between print station and recording medium happens when the print station is laterally shifted between the first and second revolution (which may be the case when this lateral shift of the print head is not controlled to the required precision), then the entire image is the "transitional region" in which only partial error hiding will be achieved.

Incidentally, in some of the embodiments the print masks are only replaced if a different relative lateral shift is detected between two print stations of a redundancy group (i.e. if the belt of a belt conveyor changes its skew angle). However, if the same lateral shift is detected for two such print stations, only the image data are shifted, but the old print masks continue to be used. In other embodiments, the print masks are even replaced in the latter case (i.e. in the case in which both print stations of the same redundancy group detect the same lateral shift). For example, if additional half-toning masks are used and combined with described error-hiding masks, as mentioned above, lateral sub-pixel shifts may be compensated by replacing the combined masks of all print stations subjected to the lateral shift by new print masks relating to the lateral position changed in common.

In some of the embodiments in which the redundancy is achieved by multiplying the number of print stations of the same color, the replacement of print masks upon detection of a lateral recording medium displacement is performed from page to page. If a lateral displacement occurs during the printing of a particular page, the print masks will only be replaced by new print masks relating to the changed lateral position at the start of the next page. Since one print process may include more than one page to be printed, the print mask replacement may take place within a print process. In some of the embodiments in which the redundancy is achieved by multiplying the number of passes, the replacement of print masks upon detection of a lateral recording medium displacement is performed for the next pass; i.e. the current print mask will only be replaced by new print mask relating to the changed lateral position at the start of the next pass. In other embodiments, the print mask replacement is performed within the currently printed page or pass upon detection of a lateral displacement. For example, a page to be printed is subdivided into several transversely extending blocks (e.g. four blocks). If a lateral position change occurs within one of those blocks, the currently used print masks are replaced by new ones relating to the changed lateral position at the start of the next block.

In some of the embodiments, the new print masks relating to a detected changed lateral position are calculated in real time ("on the fly") during the print process. In these embodiments, the newly calculated print masks replace the previous ones. For example, the previous print masks may be dropped, e.g. overwritten by the newly calculated ones.

However, in high-resolution printers with a large number of nozzles, calculating a new print mask relating to a changed lateral position may be time-consuming, even if a high-performance processor is used. In order to enable a fast compensation upon detection of a lateral shift, other embodiments are equipped with a print-mask memory arranged to store print masks for different lateral recording medium positions. Such sets of print masks for different lateral positions are, for example, pre-calculated upon detection of new nozzle errors, and stored in the print-mask memory. If, during a print process, a lateral position change is detected, the controller reads in and uses those print masks from the stored set of print masks which relate to the changed lateral position. Reading pre-calculated print masks from memory can be performed much faster than calculating new print masks. Therefore, the latter embodiments enable a nearly instantaneous compensation of lateral position changes in high-resolution printers.

In embodiments in which the print masks are only replaced if a different lateral displacement for the two print stations of a redundancy group has been detected, it is sufficient to pre-calculate and store only a set of print masks relating to the possible differences of lateral displacements. This is a relatively small number of print masks to be pre-calculated and stored. For example, if then a lateral displacement of two pixels is detected at the first print station, and a displacement of three pixels at the second print station, the common displacement by two pixels is taken into account by shifting only the image data by said two pixels. The remaining 1-pixel difference-displacement is taken into account by using the pre-calculated print mask for a 1-pixel difference-displacement compensation, explained in detail in connection with FIG. 4*f* below. For example, if the embodiment is a 1200 dpi resolution printer, the distance between dots of two adjacent nozzles is about 0.0008 inch, one print mask is necessary to compensate every 0.0008 inch lateral-difference-position change. Assuming that the maximum lateral-difference-position change of the embodiments is +/−0.004 inch, about 11 different sets of print masks are pre-calculated and stored. In other embodiments in which all lateral displacements (including equal displacements at the two print stations of a redundancy group) require a print mask replacement for the particular absolute displacement, print masks relating to all possible absolute displacements are pre-calculated and stored. Due to the number of possible combinations and such absolute displacements, the number of print masks to be pre-calculated and stored is relatively large.

As can be taken from the explanations above, redundancy may not only be achieved by multiplying the number of (physical) print stations of each color, but also by multiplying the number of passes, for example by performing two or more revolutions of the print medium in a drum system (although, of course, also in a drum system redundancy may be achieved by providing more than one physical print station of each color). The explanations made herein, in particular with regard to print activity distribution and error hiding by print masks and their replacement methods, also apply to such multi-pass systems in an analogous manner. However, in order to enable error hiding, a relative lateral shift between the print station or stations and the recording medium is actively performed between the passes. For example, if nozzle No. 10 is defective (assuming that the nozzles are numbered from left to right) and the print station is shifted by four pixels to the left before between the first and second drum revolutions, the task of the defective nozzle is taken over by nozzle No. 6 during the second revolution. The "redundancy group" then is formed by the one print station under consideration, including its print activity during the two or more passes. Different print masks are associated with the different passes forming the redundancy group. In a single-color printing device, there may be only one print station (and one redundancy group); in multi-color systems there may be several print stations of different colors, e.g. four print stations (i.e. four redundancy groups).

Although the relative lateral shift of the print station(s) between the passes is actively carried out in order to enable error hiding, it is nevertheless considered as a lateral displacement of the sort described above, which is taken into account by replacing a currently used print mask by another one relating to the new relative lateral position. In particular, in embodiments in which the active print-station displacement is not mechanically controlled to the print precision, the actual amount of performed lateral print-station shifting is detected by a lateral-position detector and handled in manner analogous to unwanted lateral belt displacements in a belt conveyor.

Returning now to FIG. 1, it shows a printing device 1 in which a recording medium 2 is conveyed in an advance direction 3 by a conveyor belt 4. The recording medium 2 is attached to belt 4, for example, by means of an hold-down vacuum system arranged below the surface of the belt 4. Page-wide-array print stations 5 are arranged along the conveyor belt 4 to produce an image from print data provided by a controller 6. In order to keep FIG. 1 simple, it shows only four print stations 5 for two colors, namely print stations C1 and C2 for "cyan", as well as print stations M1 and M2 for "magenta". The print stations of the same color (C1/C2 and M1/M2) are redundant, and the corresponding pairs each form a redundancy group. Typically, a printer has four colors with eight print stations, forming four redundancy groups. The controller 6 includes a print-mask calculator 7, a print-mask memory 8, and a print-data generator 9. A page-width nozzle-error detector 10 views printed images and forwards data representing the printed images to the controller 6. Each print station 5 is equipped with an encoding-mark sensor 11 responsive to encoding marks 10 arranged at a longitudinal edge of the conveyor belt 4. The encoding marks 12 are indicative of the belt's lateral position. Sensor signals representative of the lateral position are input into the controller 6.

The print-mask calculator 7 calculates new sets of print masks upon detection of new nozzle errors, based on data provided by the nozzle-error detector 10, and stores an updated version of the print-mask set in the print-mask memory 8. The print-data generator 9 receives image input-data 13 from the outside and transforms them to print data sent to the print stations 5 to control nozzle activity during the print process. To this end, it uses the lateral-position information provided by the encoding-mark sensors 11 to select those print masks from the print-mask memory 8 which relate to the current lateral positions, and combines the image input-data 13 with these print masks to generate the print data. If a lateral position change is detected, the currently used print masks are replaced by other print masks from the print-mask memory 8 which relate to the changed lateral position.

Figure 2A:
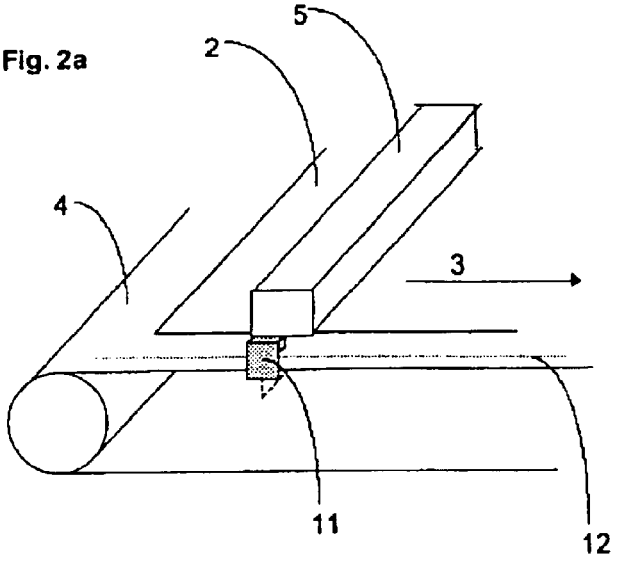
FIG. 2 illustrates an embodiment of a lateral-position detector arrangement with longitudinally extending encoding marks.
Figure 2B:
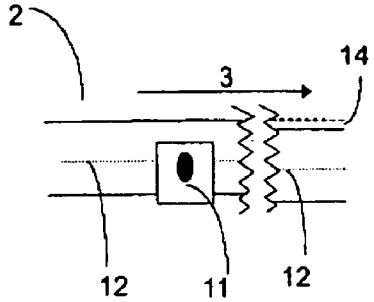

FIG. 2*a* illustrates an embodiment of a lateral-position detector arrangement with a sensor 11 arranged to detect line-like encoding marks 12 which extend in the longitudinal (or advance) direction 3. The sensor 11 extends in the lateral direction. It is responsive to lateral shifts of the encoding marks 12. In FIG. 2*b* an exemplary lateral shift is illustrated and denoted by "14".

Figure 3A:
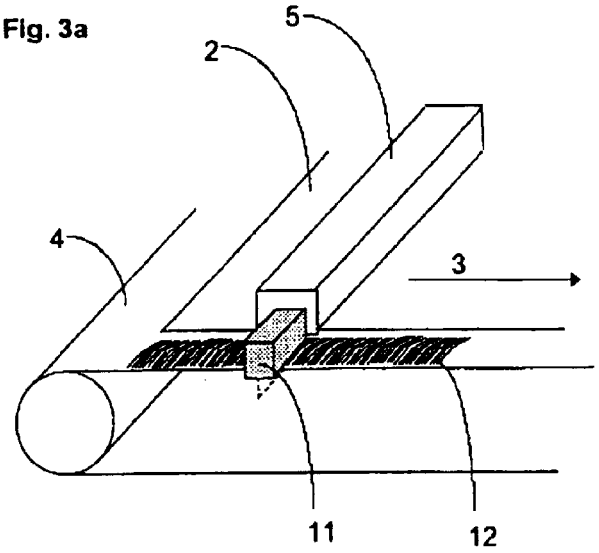
FIG. 3 illustrates another embodiment of a lateral-position detector arrangement with angled encoding marks.
Figure 3B:
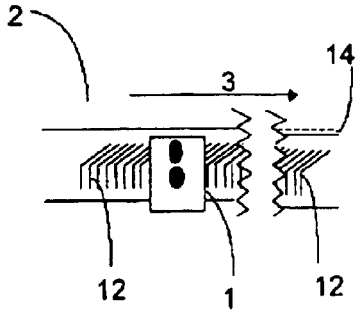

FIG. 3*a* illustrates another embodiment of a lateral-position detector arrangement based on encoding marks 12 which are formed by two lines, one of which extends in the lateral direction, and the other one in an angle (for example of 45°) with respect to the first line. The sensor 11 has two sensor elements responsive to the two lines. The delay between the two signals associated with such an angled encoder mark 12 represents the lateral position of the conveyor belt, since a lateral position change illustrated in FIG. 3*b* (denoted by "14") will result in a correspondingly changed delay between these two signals.

FIG. 4 illustrates an example of how an input image 20 is printed by two print stations 5, 5', which form a redundancy group, by using print masks 21, 21'. The input image 20 is represented by image input-data 13 (FIG. 1). The print mask 21 is associated with the first print station 5, and the print mask 21' is associated with the second print station 5' of the redundancy group. FIG. 4 also illustrates an area 22 inked by the first print station 5, as well as an area 22' inked by the second print station 5'. It also illustrates the finally printed image 23 which is a combination of the inked areas 22 and 22'. The controller 6 (FIG. 1) performs a logical AND of the input image 20 and the print mask 21, or 21', of the respective print station 5, or 5'. The logical value "1" is illustrated by black or gray squares in FIG. 4, and the logical value "0" is illustrated by white squares. The print masks 21, 21' have a generally checkered pattern and are normally complementary so that a combination of both print marks 21, 21' would lead to a completely gray area (i.e. an area having only logical values "1").

In FIG. 4, it is assumed that one nozzle of the second print station 5' is faulty; the position of the faulty nozzle is illustrated by a white field in the print station 5'. The generally checkerboard-like patterns of the print masks 21, 21' are "disturbed" so as to hide the faulty nozzle of the first print station 5'.

Figures 4A, 4B, 4C, 4D, 4E, 4F:
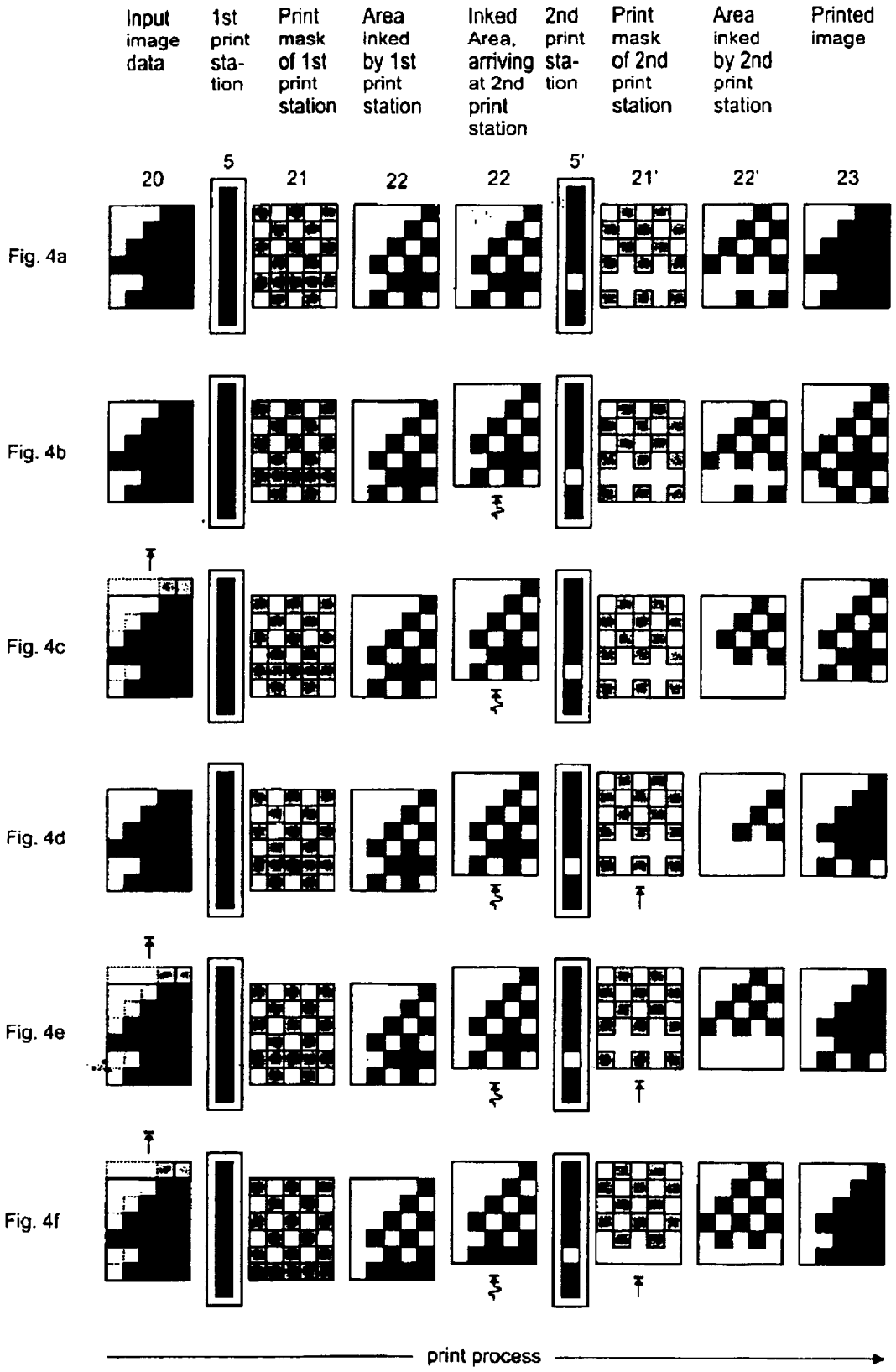
FIG. 4 illustrates print control of two redundant print stations for six different cases (a–f), including cases with a lateral recording medium shift and different attempts to compensate it (b–f)

FIG. 4*a* illustrates the case in which no lateral displacement of the belt 4 (FIG. 1) has occurred. The row of print mask 21' that corresponds to the faulty nozzle in the print station 5' (the fifth nozzle seen from the top in FIG. 4) is completely set to "0", rendering the faulty nozzle of the second print station 5' inactive. Correspondingly, the same row of the first print station's complementary print mask 21 is completely set to "1", which means that the corresponding nozzle of the first print station 5 takes over the function of the faulty nozzle. Both print masks 21, 21' are complementary and, when combined, cover the entire print area. As illustrated in FIG. 4*a*, the area 22 inked by the first print station 5 is a checkerboard-like part of the input image 20, wherein the fifth row is completely printed. The area 22' inked by the second print station 5' is the complementary checkerboard-like pattern within the input image 20, wherein said row (which has been completely printed by the first print station 5) is left blank. The combination of the inked areas 22, 22' is the actually printed image 23. As can be seen in FIG. 4*a*, the printed image 23 equals the input image 20. Consequently, the nozzle error of the first print station 5 is perfectly hidden.

FIGS. 4*b* to 4*f* illustrate cases in which the print medium is laterally shifted between the first print station 5 and the second print station 5'. In the example of FIG. 4, the print medium is shifted by one pixel to the top of FIG. 4, which is illustrated by two relatively shifted plots of the inked area 22, one of which being provided with a wavy arrow indicating the lateral shift of the print-medium.

FIG. 4*b* illustrates what will happen if no activity is taken to compensate the lateral displacement of the print medium, i.e. if neither the image data are shifted nor the print masks are shifted or changed. Since the assumed lateral displacement only occurs after the first print station 5, the inked area 22 produced by the first print station 5 is the same as the one in FIG. 4*a*. However, due to the displacement of the print medium by one pixel (in the upward direction in FIG. 4), the second print station's print mask 21' is effectively (i.e. relating to the occurred lateral shift of the print medium) no longer complementary to the first print station's print mask 21. The inked area 22' is produced by the second print station 5' with an effective displacement of one pixel downwards relative to the already inked area 22. As a consequence of the fact that the two, mainly checkerboard-like, print masks 21, 21' are effectively not complementary, many of the pixels of the printed image 23 are inked twice, and many others are left blank, resulting in an image of relatively poor image quality.

FIG. 4*c* illustrates what will happen if only the image data are shifted for the second print station 5' in order to compensate the detected lateral shift of the recording medium. In FIG. 4*c*, a corresponding shift of the image data relative to the second print station 5' by one pixel in the upward direction is indicated by an overlaid shifted input image data 20 (shown in gray) and by an arrow above the field 20. The second print station's print mask 21' is effectively not complementary to the first print station's print mask 21, as in FIG. 4*b*. Again, as a result, many of the pixels of the printed image 23 are inked twice, and many others are left blank, resulting in an image of relatively poor image quality, similar to the one obtained in FIG. 4*b*.

FIG. 4*d* illustrates what will happen if only the print mask 21' of the second print station 5', but not the input image data 20, is shifted upwardly by one pixel in order to compensate the detected lateral shift of the print medium (the shift of the print mask 21' is indicated by arrow in FIG. 4*d*). A certain improvement is now achieved, owing to the fact that the regular checkerboard-like parts of the print masks are now again complementary (relating to the occurred lateral shift of the print medium). However, as the positions of faulty nozzles are physically fixed at the respective print station (in FIG. 4, the position of the second print stations' faulty nozzle is fixed at the position of the fifth nozzle), such a shift of the print mask 21' does not cause the faulty nozzle to be shifted in unison. Rather, the faulty nozzle stays where it is, and the shifted print mask 21' therefore no longer corresponds to the faulty-nozzle situation. As can be seen in FIG. 4*d*, the shifted print mask 21' has a blank row, although the corresponding nozzle of the second print station is operative, but has a normal checkerboard row at the position of the faulty nozzle. As a consequence, no complete error hiding is achieved. Nevertheless, the final printed image 23 has a better image quality than the one of FIGS. 4*b* and 4*c*, due to the effective complementarity of the print masks 21, 21' in their regular parts.

FIG. 4*e* illustrates what will happen if not only the input image 20 is shifted (as in FIG. 4*c*), but also the print mask 21 of the second print station 5' is shifted upwardly (as in FIG. 4*d*) by one pixel in order to compensate the detected lateral shift. Again, no complete error hiding is achieved. The printed image is similar to the one obtained in FIG. 4*d*.

This illustrates that a complete error hiding is generally not achieved by simply countershifting the input image and the print mask of a print station at which a lateral shift is detected.

Figure 5:
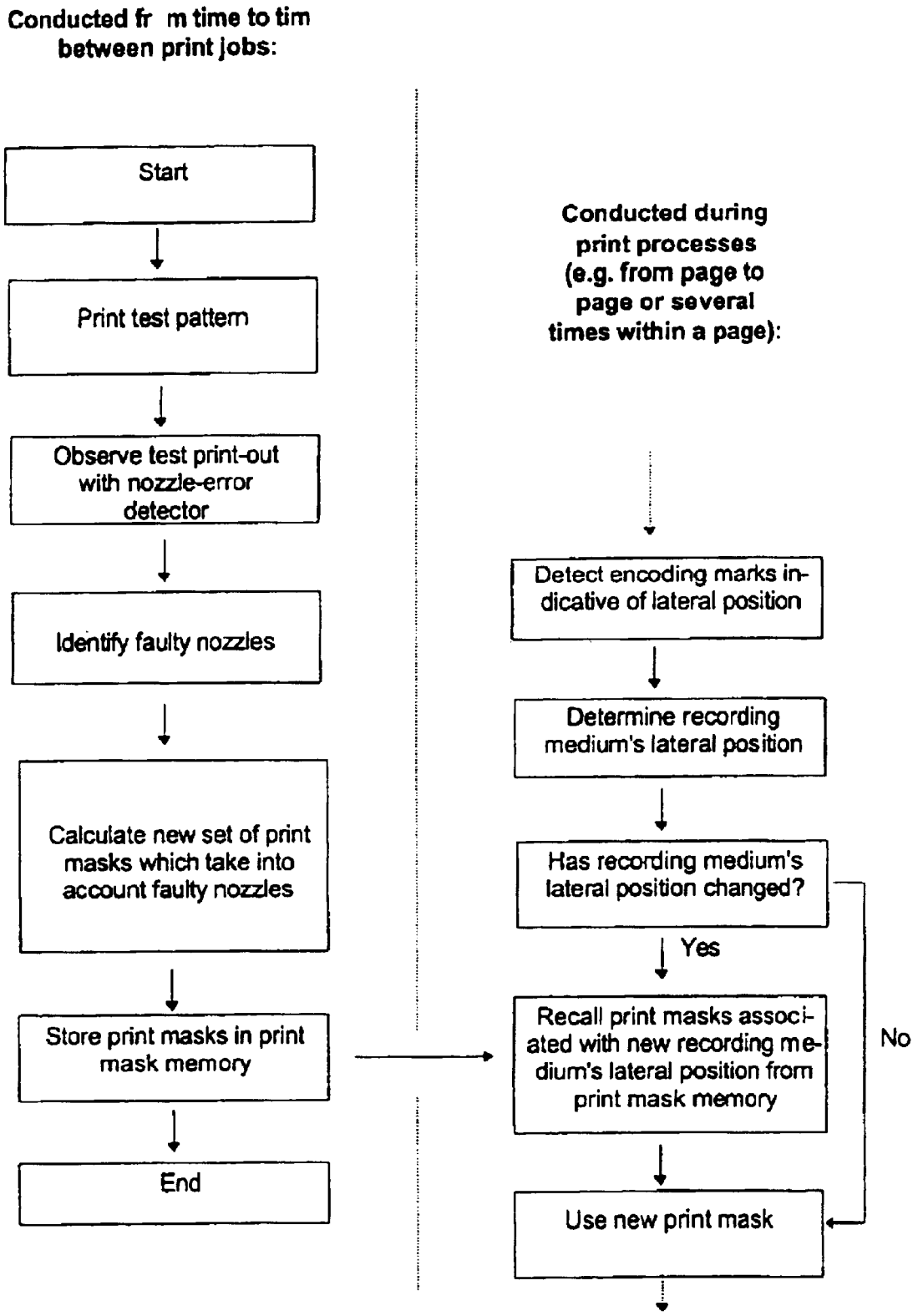
FIG. 5 is a flow diagram illustrating pre-calculation of print masks and their use during printing in order to compensate lateral position changes.

FIG. 4*f* illustrates the full error-hiding approach. Both the input image data 20 and the second print mask 21' are shifted upwardly by one pixel, as illustrated in FIG. 4*e*. In addition, the changed position of the faulty nozzle relative to the shifted recording medium is taken into account in the new print mask 21'. As can be seen in FIG. 4*f*, the print mask's row which is entirely set to the value "0" is now at the sixth row (rather than its fifth row), corresponding to the changed relative position of the faulty nozzle. Since the print mask 21, 21' of the redundancy group ought to be complementary, also the first print mask 21 is replaced by a new print mask 21 the sixth row of which (rather than the fifth row) is entirely set to the logical value "1". The new print mask 21 causes the first head to print all pixels which the second print stations defective nozzle cannot print; in turn, the new print mask 21' disables only the defective nozzle. As can be seen in FIG. 4*f*, the finally printed image 23 equals the input image 20. Accordingly, by the print-mask replacing method illustrated in FIG. 4*f*, complete error hiding is achieved. FIG. 5. shows a flow diagram of two exemplary processes relating the lateral-position-change compensation with error-hiding print masks described above. The process illustrated at the left-hand side of FIG. 5 runs from time to time between print jobs. It starts with printing a test pattern, which is observed by the nozzle-error detector 10 (FIG. 1). The sensor data is analyzed to identify faulty nozzles. If new faulty nozzles are detected, a new set of print masks is calculated which also takes into account the new faulty nozzles. The set includes correlated print masks for each print station and each possible set of lateral positions of the recording medium at the different print stations. The calculated new set of print masks is stored in the print-mask memory.

The process illustrated at the right-hand side of FIG. 5 runs during print processes, for example from page to page, or several times within a page. In FIG. 5, it is assumed that certain print masks are already in use for a given lateral position of the recording medium. During the print process, encoding marks indicative of the recording medium's lateral position are constantly detected, and the recording medium's position is determined based on this. If a lateral position change is detected, the pre-calculated print masks associated with the new lateral position of the recording medium are recalled from the print-mask memory. Printing is to be continued with the new print masks instead of the previous ones.

Figure 6:
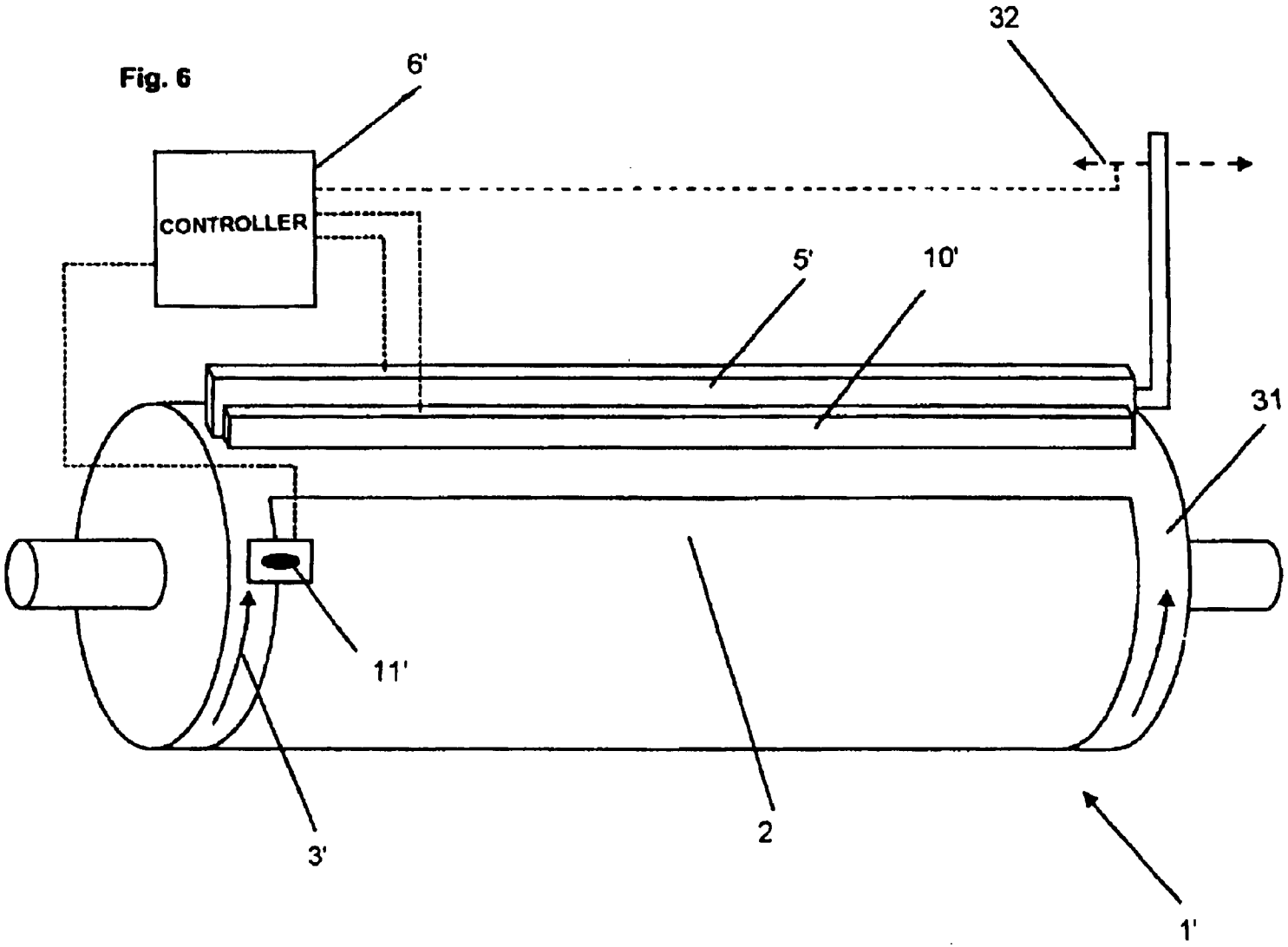
FIG. 6 illustrates another embodiment of a printing device having a drum conveyor.

FIG. 6 illustrates a printing device 1' having a conveyor in the form of a drum 31. A recording medium 2 is attached to the drum 31, for example by means of a vacuum system within the drum 31. Upon rotation of the drum 31, the recording medium is moved past a page-wide-array print station 5'. In order to keep FIG. 6 simple, only one print station 5' is shown; however, a multi-color printer will typically have a number of single-color page-wide-array print stations corresponding to the number of colors used, i.e. typically four or six print stations. The print station 5' is equipped with an array of ink-jet nozzles; it may be segmented in print heads. A page-wide nozzle-error detector 10' is attached to the print station 5 and enables faulty nozzles to be directly detected, e.g. using a light-barrier array, a noise detector array or a capacitance-change detector array.

An actuator 32, e.g. a piezo actuator, is provided which enables the print station 5' to be shifted in the lateral (i.e. axial) direction in a controlled manner. The actuator 32 is equipped with a print-station-displacement-measurement device which measures the print station's current lateral position. The actuator 32 is controlled by a controller 6' of the printing device 1', and the print-station-displacement-measurement device supplies its signals back to the controller 6'.

In the printing device 1' of FIG. 6, redundancy is achieved by rotating the recording medium more than once past the print station 5', and by laterally shifting the print station 5' between the drum revolutions. The controller 6' provides the print station 6' with a first print mask for the first revolution, and with a second, complementary print mask for the second revolution (in the case of two-fold redundancy).

A recording-medium sensor 11' is arranged to measure the recording medium's current lateral position near the print station 5'. It is, for example, an optical surface-recording arrangement which detects and records surface images of the recording medium (e.g. of the fiber structure of a paper sheet) during the drum rotation. It detects lateral displacements of the recording medium by comparing currently detected surface images with stored surface images recorded during the previous revolution(s). In some embodiments, two such sensors are positioned at a small distance along the circumference of the drum. The second sensor detects lateral displacements of the recording medium by comparing currently detected surface images with stored surface images just recorded by the first sensor. This enables lateral displacements of the recording medium to be immediately (i.e. within the currently printed page) detected and corrected (by replacing the current print mask by a new one relating to the changed lateral position). Information obtained about lateral displacements of the recording medium are input into the controller 6'.

The controller 6' provides the print station 5' with image data to be printed and print masks controlling the print activity. The print masks are arranged such that print activity distribution and error hiding is achieved, as explained in connection with FIG. 4 (however, a complete error hiding will not be achieved in what has been called the "transitional region" above). If the print station's lateral position is changed by the actuator 32 and/or an unintended lateral displacement of the recording medium 2 relative to the drum 31 is observed, the currently used print mask is replaced by another one relating to the new lateral position of the print station 5', measured by the print-station-displacement-measurement device, and/or the recording medium 2, measured by the recording-medium sensor 11'. The new print mask relates to the new relative lateral position between the print station 5' and the recording medium 2. The mechanisms of the print activity distribution, error hiding and print mask generation and replacement are analogous to what has been described above, also in connection with FIG. 4. The controller 6' is analogous to the controller 6 of FIG. 1; for example, it has a print mask calculator, a print mask memory, and a print data generator.

Faulty nozzles are observed by the nozzle-error detector 10', and new sets of print masks which take into account the observed faulty nozzles are pre-calculated and stored in the print mask memory, as described above, also in connection with the left-hand side of FIG. 5. During the print process, after having determined an (intended or unintended) shift of the relative lateral position between the print station 5' and the recording medium 2, the print mask associated with the new relative lateral position are recalled from the print mask memory and are used during the print process, as described above, also in connection with the right-hand side of FIG. 5.

Thus, the multi-station and multi-pass embodiments described above, in particular the devices 1, 1' of FIGS. 1 and 6, are analogously arranged and controlled, and work in an analogous manner. That parts of the description of features of the multi-station embodiments which have not been expressly mentioned in connection with the multi-pass embodiments, therefore also apply in an analogous manner to the multi-pass embodiments.

The embodiments described enable lateral-position changes of the recording medium to be compensated in printing devices using error-hiding print masks. The compensation may be performed in real time during the print process. Thereby, image quality is improved.

All publications and existing systems mentioned in this specification are herein incorporated by reference.

Although certain methods and products constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A printing device, comprising:

a plurality of print stations including dot-forming elements arranged to produce an image on a moving recording medium and provided in a redundant manner, thereby enabling dot-forming-element activity to be distributed between redundant dot-forming elements and errors of dot-forming elements to be compensated;

a lateral-position detector arrangement or predictor arranged to indicate the recording medium's lateral position relative to the print stations during a print process; and a controller arranged to use at least one print mask for each print station arranged to distribute the dot-forming-element activity between the print stations and to compensate the errors of dot-forming elements; wherein the printing device is arranged so that, in response to a detected or predicted change of the relative lateral position, at least one of the currently used print masks is replaced by another one relating to the changed relative lateral position.

2. The printing device of claim 1, further comprising:

a conveyor arranged to move the recording medium during the print process.

3. The printing device of claim 2, wherein the conveyor is a belt conveyor.

4. The printing device of claim 2, wherein the lateral-position detector arrangement is arranged to detect the conveyor's lateral position, which represents an indication of the recording medium's lateral position.

5. The printing device of claim 1, further comprising:

a plurality of encoding marks which move with the moving recording medium and are indicative of the recording medium's lateral position;

wherein the lateral-position detector arrangement comprises at least one sensor responsive to the encoding marks and arranged to detect the recording medium's lateral position.

6. The printing device of claim 1, wherein at least some of the print masks are correlated, wherein the printing device is arranged so that, in response to a detected or predicted change of the relative lateral position, the correlated print masks relating to the changed relative lateral position are replaced by others.

7. The printing device of claim 1, wherein the lateral-position detector arrangement or predictor is arranged to at least indicate the lateral position of the recording medium from page to page during the print process; and the printing device is arranged so that, in response to a detected or predicted change of the relative lateral position, the at least one of the currently used print masks is replaced from page to page by another one relating to the changed relative lateral position.

8. The printing device of claim 1, wherein the lateral-position detector arrangement or predictor is arranged to indicate the lateral position of the recording medium within a page during the print process; and the printing device is arranged so that, in response to a detected or predicted change of the relative lateral position, the at least one of the currently used print masks is replaced within the page by another one relating to the changed relative lateral position.

9. The printing device of claim 1, further comprising:

a print-mask memory arranged to store print masks for different relative lateral recording medium's positions; wherein the controller is arranged, in response to a detected or predicted change of the relative lateral position, to use at least one other print mask from the stored print masks than the currently used one, this at least one other print mask relating to the changed relative lateral position.

10. The printing device of claim 1, further comprising:

a dot-forming-element error detector;

wherein the printing device is arranged, in response to newly detected dot-forming-element errors, to replace existing print masks by new print masks which also compensate the newly detected dot-forming-element errors.

11. The printing device of claim 1, wherein the print masks of redundant print stations associated with each other are complementary patterns minimizing or reducing blocks of contiguous dots or picture elements printed by each print station.

12. The printing device of claim 1, wherein the print masks of two redundant print stations associated with each other are complementary checkerboard-like patterns.

13. The printing device of claim 1, where the printing device is a multi-color printer.

14. The printing device of claim 1, where the printing device is an ink-jet printer.

15. The printing device of claim 1, where the printing device is a page-wide-array printer.

16. A printing device, comprising:

a plurality of print stations including dot-forming elements arranged to produce an image on a moving recording medium and provided in a redundant manner, thereby enabling dot-forming-element activity to be distributed between redundant dot-forming elements and errors of dot-forming elements to be compensated;

a lateral-position detector arrangement or predictor arranged to indicate the recording medium's lateral position relative to the print stations during a print process; and a controller arranged to use at least one print mask for each print station arranged to distribute the dot-forming-element activity between the print stations and to compensate the errors of dot-forming elements; and a print-mask memory arranged to store print masks for different relative lateral recording medium's positions; wherein the controller is arranged, in response to a detected or predicted change of the relative lateral position, to use at least one other print mask from the stored print masks than the currently used one, this at least one other print mask relating to the changed relative lateral position.

17. The printing device of claim 16, wherein at least some of the print masks are correlated, wherein the controller is arranged, in response to a detected or predicted change of the relative lateral position, to use other correlated print masks from the stored print masks than the currently used ones, these other ones relating to the changed relative lateral position.

18. The printing device of claim 16, wherein the lateral-position detector arrangement or predictor is arranged to at least indicate the lateral position of the recording medium from page to page during the print process; and the controller is arranged, in response to a detected or predicted change of the relative lateral position, to use, from page to page, at least one other print mask from the stored print masks than the currently used one, this at least one other print mask relating to the changed relative lateral position.

19. The printing device of claim 16, wherein the lateral-position detector arrangement or predictor is arranged to indicate the lateral position of the recording medium within a page during the print process; and the controller is arranged, in response to a detected or predicted change of the relative lateral position, to use, within the page, at least one other print mask from the stored print masks than the currently used one, this at least one other print mask relating to the changed relative lateral position.

20. The printing device of claim 16, further comprising:

a dot-forming-element error detector;

wherein the printing device is arranged, in response to newly detected dot-forming-element errors, to replace existing stored print masks for the different relative lateral recording medium's positions by new print masks for the different relative lateral recording medium's positions which also compensate the newly detected dot-forming-element errors, and store the new print mask in the print-mask memory.

21. A printing device, comprising:

at least one print station including dot-forming elements arranged to produce an image on a moving recording medium;

a drum arranged to convey the recording medium past the at least one print station, wherein, by performing more than one turn, the drum is enabled to convey the recording medium more than once past the at least one print station, thereby creating an effective dot-forming-element redundancy;

a lateral-shift mechanism arranged to perform a relative lateral shift between the print station and the recording medium from one drum turn to another drum turn, thereby enabling dot-forming-element activity to be distributed between drum turns and errors of dot-forming elements to be compensated;

a lateral-position detector arrangement or predictor arranged to indicate the relative lateral shift between the recording medium and the print station; and a controller arranged to use at least one print mask for the at least one print station for each drum turn and each detected or predicted relative lateral position between the print station and the recording medium, wherein the print masks are arranged to distribute the dot-forming-element activity between the drum turns and, in addition, to compensate the errors of dot-forming elements.

22. The printing device of claim 21, wherein the lateral-position detector arrangement is arranged to detect the drum's lateral position, which represents an indication of the recording medium's lateral position.

23. The printing device of claim 21, wherein the lateral-position detector arrangement is arranged to directly detect the recording medium's lateral position.

24. The printing device of claim 21, wherein the lateral-position detector arrangement is arranged to detect the print station's lateral position.

25. The printing device of claim 21, wherein at least some of the print masks are correlated, wherein the printing device is arranged so that, in response to a detected or predicted change of the relative lateral position, the correlated print masks relating to the changed relative lateral position are replaced by others.

26. The printing device of claim 21, wherein the lateral-position detector arrangement or predictor is arranged to at least indicate the relative lateral position of the recording medium from drum turn to drum turn during the print process.

27. The printing device of claim 21, wherein the lateral-position detector arrangement or predictor is arranged to indicate the relative lateral position of the recording medium within a drum turn during the print process; and the printing device is arranged so that, in response to a detected or predicted change of the relative lateral position, the at least one of the currently used print masks is replaced within the drum turn by another one relating to the changed relative lateral position.

28. The printing device of claim 21, further comprising:

a print-mask memory arranged to store print masks for different relative lateral recording medium's positions; wherein the controller is arranged, in response to a detected or predicted change of the relative lateral position, to use at least one other print mask from the stored print masks than the currently used one, this at least one other print mask relating to the changed relative lateral position.

29. The printing device of claim 21, further comprising:

a dot-forming-element error detector;

wherein the printing device is arranged, in response to newly detected dot-forming-element errors, to replace existing print masks by new print masks which also compensate the newly detected dot-forming-element errors.

30. The printing device of claim 21, wherein the print masks of redundant drum turns associated with each other are complementary patterns minimizing or reducing blocks of contiguous dots or picture elements printed during the respective drum turn.

31. The printing device of claim 21, wherein the print masks of two redundant drum turns associated with each other are complementary checkerboard-like patterns.

32. The printing device of claim 21, where the printing device is a multi-color printer.

33. The printing device of claim 21, where the printing device is an ink-jet printer.

34. The printing device of claim 21, where the printing device is a page-wide-array printer.

35. A printing device, comprising:

at least one print station including dot-forming elements arranged to produce an image on a moving recording medium;

a drum arranged to convey the recording medium past the at least one print station, wherein, by performing more than one turn, the drum is enabled to convey the recording medium more than once past the at least one print station, thereby creating an effective dot-forming-element redundancy;

a lateral-shift mechanism arranged to perform a relative lateral shift between the print station and the recording medium from one drum turn to another drum turn, thereby enabling dot-forming-element activity to be distributed between drum turns and errors of dot-forming elements to be compensated;

a lateral-position detector arrangement or predictor arranged to indicate the recording medium's lateral position relative to the print station;

a print-mask memory arranged to store print masks for each drum turn and each detected or predicted relative lateral position between the print station and the recording medium, wherein the print masks are arranged to distribute the dot-forming-element activity between the drum turns and in addition to compensate the errors of dot-forming elements; and a controller arranged to use at least one print mask from the stored print masks for the at least one print station during the printing operation.

36. The printing device of claim 35, wherein at least some of the print masks are correlated, wherein the controller is arranged, in response to a detected or predicted change of the relative lateral position, to use other correlated print masks from the stored print masks than the currently used ones, these other ones relating to the changed relative lateral position.

37. The printing device of claim 35, wherein the lateral-position detector arrangement or predictor is arranged to at least indicate the lateral position of the recording medium from drum turn to drum turn during the print process; and the controller is arranged, in response to a detected or predicted change of the relative lateral position, to use, from drum turn to drum turn, at least one other print mask from the stored print masks than the currently used one, this at least one other print mask relating to the changed relative lateral position.

38. The printing device of claim 35, wherein the lateral-position detector arrangement or predictor is arranged to indicate the lateral position of the recording medium within a drum turn during the print process; and the controller is arranged, in response to a detected or predicted change of the relative lateral position, to use, within the drum turn, at least one other print mask from the stored print masks than the currently used one, this at least one other print mask relating to the changed relative lateral position.

39. The printing device of claim 35, further comprising:

a dot-forming-element error detector;

wherein the printing device is arranged, in response to newly detected dot-forming-element errors, to replace existing stored print masks for the different relative lateral recording medium's positions by new print masks for the different relative lateral recording medium's positions which also compensate the newly detected dot-forming-element errors, and store the new print mask in the print-mask memory.

40. A method of compensating lateral position changes of a moving recording medium during a print process, in which at least one image is printed by a plurality of print stations including dot-forming elements, based on image data, wherein redundant dot-forming elements are provided, thereby enabling dot-forming-element activity to be distributed between redundant dot-forming elements, and errors of dot-forming elements to be compensated, by using print masks; comprising:

detecting or predicting the lateral position of the recording medium relative to the print stations during a print process;

using the image data and at least one print mask for each print station to distribute the dot-forming-element activity between the print stations and to compensate the errors of dot-forming elements; and replacing, in response to a detected or predicted change of the relative lateral position, at least one of the currently used print masks by another one relating to the changed relative lateral position.

41. The method of claim 40, the step of replacing at least one of the currently used print masks, further comprises the step of, in response to the detected or predicted change of the lateral position between a first and a second print stations of said plurality of print stations, shifting the image date to be printed by said second print station.

42. A method of compensating lateral position changes of a moving recording medium during a print process, in which at least one image is printed by a plurality of print stations including dot-forming elements, based on image data, wherein redundant dot-forming elements are provided, thereby enabling dot-forming-element activity to be distributed between redundant dot-forming elements, and errors of dot-forming elements to be compensated, by using print masks, wherein a set of such print masks for different relative lateral positions of the recording medium is pre-calculated and stored; comprising:

detecting or predicting the lateral position of the recording medium relative to the print stations during a print process;

using the image data and at least one print mask for each print station to distribute the dot-forming-element activity between the print stations and to compensate the errors of dot-forming elements; and using, in response to a detected or predicted change of the relative lateral position, at least one other print mask from the stored print masks than the currently used one, this at least one other print mask relating to the changed relative lateral position.

43. The method of claim 42, the step of using at least one other print masks, further comprises the step of, in response to the changed relative lateral position between a first and a second print stations of said plurality of print stations, shifting the image date to be printed by said second print station.

44. A method of compensating lateral relative position changes of a moving recording medium during a print process, in which at least one image is printed, based on image data, by at least one print station of a drum system during more than one drum turn, wherein effective dot-forming-element redundancy is created by executing additional drum turns and laterally shifting the print station between drum turns, thereby enabling dot-forming-element activity to be distributed between the drum turns and errors of dot-forming elements to be compensated, by using print masks; comprising:

detecting or predicting the lateral position of the recording medium relative to the at least one print station during a print process;

using the image data and at least one print mask for each print station for each drum turn and detected or predicted relative lateral position between the print station and the recording medium, wherein the print masks distribute dot-forming-element activity between the drum turns and, in addition, compensate the errors of dot-forming elements.

45. The method of claim 44, the using step further comprises the step of, in response to the detected or predicted change of the lateral position between a first and a second drum turn of said more than one turns, shifting the image date to be printed by said print station during said second turn.

46. A method of compensating lateral relative position changes of a moving recording medium during a print process, in which at least one image is printed, based on image data, by at least one print station of a drum system during more than one drum turn, wherein effective dot-forming-element redundancy is created by executing additional drum turns and laterally shifting the print station between drum turns, thereby enabling dot-forming-element activity to be distributed between the drum turns and errors of dot-forming elements to be compensated, by using print masks, wherein a set of such print masks for different relative lateral positions of the recording medium is pre-calculated and stored; comprising:

detecting or predicting the lateral position of the recording medium relative to the at least one print station during a print process;

using the image data and at least one print mask from the stored print masks for each print station for each drum turn and detected or predicted relative lateral position between the print station and the recording medium, wherein the print masks distribute dot-forming-element activity between the drum turns and, in addition, compensate the errors of dot-forming elements.

47. The method of claim 46, the using step further comprises the step of, in response to the detected or predicted relative lateral position between a first and a second drum turn of said more than one turns, shifting the image date to be printed by said print station during said second turn.

* * * * *